US005664856A

United States Patent [19]

Pacetti

[11] Patent Number: 5,664,856

[45] Date of Patent: Sep. 9, 1997

[54] STACKABLE DIVIDED DRAWER PARTITION

[75] Inventor: Larry D. Pacetti, Kenosha, Wis.

[73] Assignee: Snap-on Technologies, Inc., Lincolnshire, Ill.

[21] Appl. No.: 663,536

[22] Filed: May 30, 1996

Related U.S. Application Data

[62] Division of Ser. No. 195,157, Feb. 17, 1994, Pat. No. 5,607,215.

[51] Int. Cl.[6] ..... A47B 88/00

[52] U.S. Cl. ..... 312/348.3; 211/184; 220/533

[58] Field of Search ..... 312/348.3, 330.1, 312/107, 108, 334.29, 334.27, 334.36, 351; 211/184; 220/532, 533

[56] References Cited

U.S. PATENT DOCUMENTS

| | | | |
|---|---|---|---|
| 1,995,335 | 3/1935 | Wilke . | |
| 2,811,404 | 10/1957 | Brooks et al. . | |
| 3,244,289 | 4/1966 | King . | |
| 3,375,830 | 4/1968 | Dixon et al. . | |
| 3,468,591 | 9/1969 | Wodli . | |
| 4,000,817 | 1/1977 | Sanders et al. . | |
| 4,164,309 | 8/1979 | Staats . | |
| 4,209,093 | 6/1980 | Soderland . | |
| 4,436,215 | 3/1984 | Kleinart | 220/533 |
| 4,577,773 | 3/1986 | Bitel | 220/533 |
| 4,593,816 | 6/1986 | Langenbeck . | |
| 4,643,306 | 2/1987 | Ryan . | |
| 4,643,494 | 2/1987 | Marleau . | |
| 4,705,168 | 11/1987 | Ward . | |
| 4,714,158 | 12/1987 | Oltman et al. . | |
| 4,722,453 | 2/1988 | Hamilton . | |
| 4,884,689 | 12/1989 | Su-Chin . | |
| 4,940,156 | 7/1990 | Cote et al. . | |
| 5,014,850 | 5/1991 | Huff . | |
| 5,167,433 | 12/1992 | Ryan . | |
| 5,553,710 | 9/1996 | Takama | 220/533 |
| 5,607,215 | 3/1997 | Pacetti et al. | 312/348.3 |

FOREIGN PATENT DOCUMENTS

| | | | |
|---|---|---|---|
| 2425823 | 1/1980 | France . | |
| 2566251 | 12/1985 | France | 312/348.3 |
| 2944683 | 5/1981 | Germany | 312/348.3 |
| 3810531 | 10/1989 | Germany | 312/348.3 |
| 091013002 | 9/1991 | WIPO | 312/348.3 |

OTHER PUBLICATIONS

Matco Catalog pp. 17, 23 no date; no author.
Mac Catalog p. 37 no date; no author.
Craftsman Catalog pp. 8, 31 no date; no author.
Waterloo Catalog pp. 14, 29 no date; no author.
Williams Catalog p. 21 no date; no author.
Stanley Proto Catalog pp. 228, 3–6, 3–8 no author; no date.
Kennedy Catalog pp. 3, 4 no date; no author
Lyon's Catalog pp. 36, 46–47 no date; no author.
Equipto Catalog pp. 17–18, 41–42 no date; no author.
Stanley Vidmar Catalog pp. 12–14 no date; no author.
Facom Catalog page no date; no author.
USAG Catalog page no date; no author.
Belzer–Dowidat GmbH Catalog page no date; no author.
Hazet Catalog p. 174 no date; no author.
Pador Catalog p. 96 no date; no author.
Zelenka Catalog page no date; no author.
Wilhelm Batgen Catalog page no date; no author.
Lista Catalog pp. 11, 74–76, 78–79 no date; no author.
Bott Catalog pp. 6.0–6.5; no date; no author.
Snap–on Catalog p. 30 no date; no author.
Rousseau Catalog page no date; no author.

*Primary Examiner*—Peter M. Cuomo
*Assistant Examiner*—Gerald Anderson
*Attorney, Agent, or Firm*—Emrich & Dithmar

[57] ABSTRACT

A drawer partition includes a molded, one-piece, plastic tray with a base wall and upstanding side walls. The side walls have laterally aligned and longitudinally spaced-apart dovetail-shaped grooves in the inner surfaces thereof slidably mateable with dovetail-shaped tongues at the ends of divider panels for dividing the tray into compartments. Pairs of ribs define slots on the side walls to receive end edges of the divider panels. Pairs of flexible legs on the bottom edge of the divider panel are snap-fitted into apertures in the base wall to lock the divider panels in place. The bottom outside edges of the side walls have longitudinal grooves mateable respectively with the upper edges of the side walls of another partition to facilitate guided longitudinal relative sliding movement of stacked partitions. Each tray has front and rear end portions which respectively have recessed outer and inner surfaces to permit overlapping nesting of the ends of longitudinally aligned partitions.

12 Claims, 3 Drawing Sheets

FIG. 1
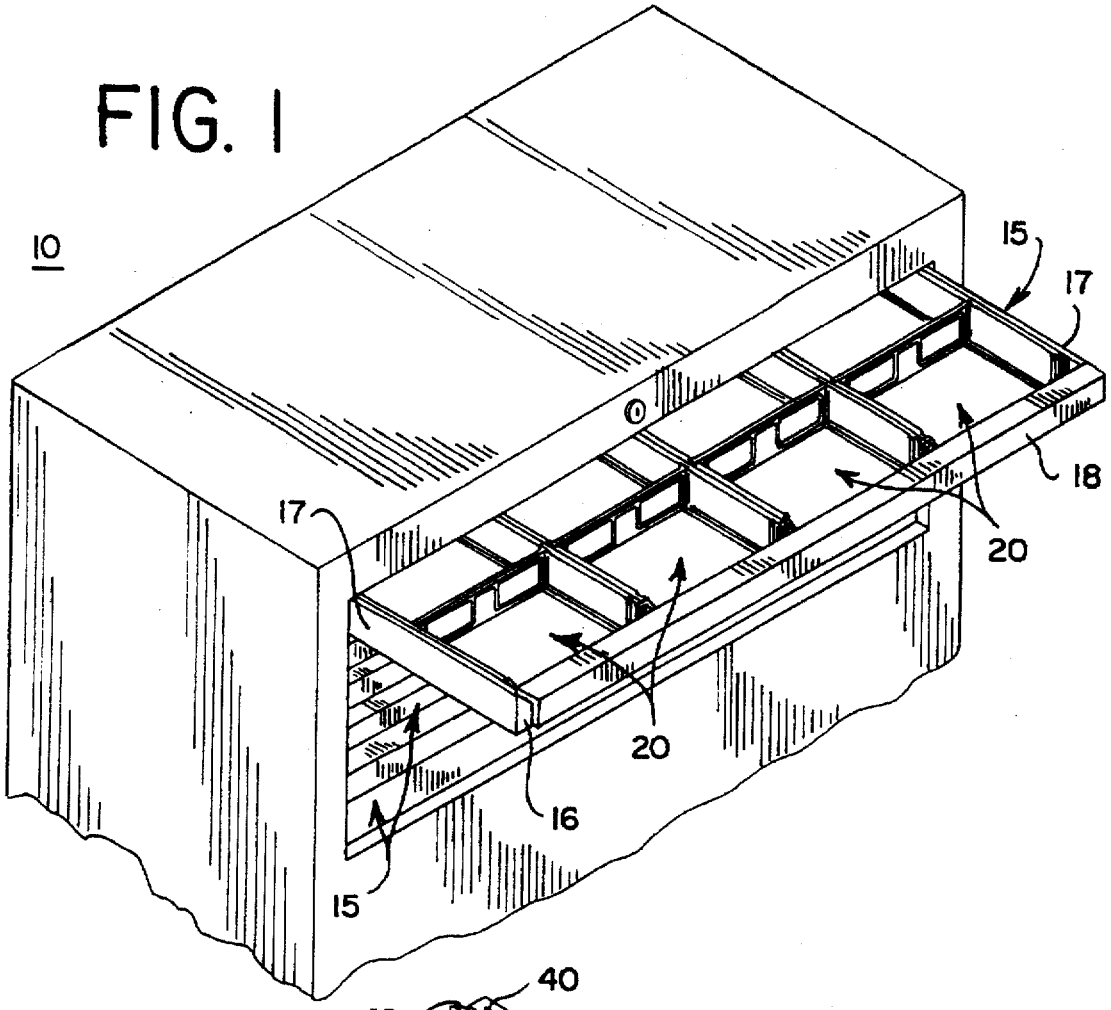
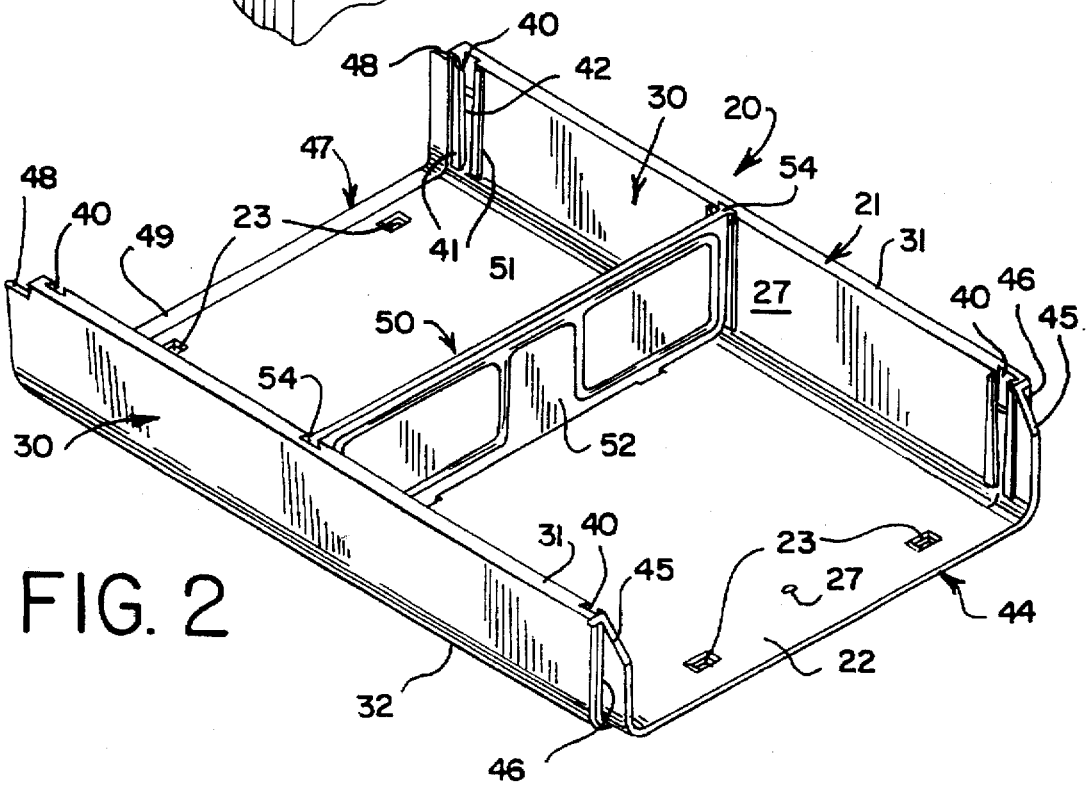
FIG. 2

STACKABLE DIVIDED DRAWER PARTITION

This is a divisional of application Ser. No. 08/195,157, now U.S. Pat. No. 5,607,215 filed Feb. 17, 1994.

BACKGROUND OF THE INVENTION

1. Field of the Invention

The present invention relates to devices for organizing the contents of drawers. The invention particularly relates to a drawer partition system including insertable, integrally formed drawer partitions for dividing a drawer into a plurality of compartments.

2. Description of the Prior Art

It is often desirable that drawers in storage chests, such as tool chests, be capable of subdivision into a plurality of compartments for segregating various articles stored therein. Many systems have been devised for this purpose, including systems utilizing insertable, elongated, channel-shaped trays. Typically, such trays are produced in a variety of heights or depths for use with different-depth drawers. This requires a large inventory of parts. Also, prior partition trays have typically been provided in lengths to match the front-to-back length of a specific drawer. This also requires a large inventory of partition lengths to accommodate different-length drawers.

It is known to provide such partition trays with removable divider panels for subdividing each partition tray into sub-compartments. In many such arrangements, the divider panels simply drop into slots or grooves and can easily be dislodged in use. Arrangements have been provided for locking such divider panels in place, but they have heretofore generally involved the use of additional discrete locking elements or complex locking arrangements requiring locking to both horizontal and vertical surfaces in the partition tray.

SUMMARY OF THE INVENTION

It is a general object of the present invention to provide an improved drawer partition which avoids the disadvantages of prior partitions while affording additional structural and operating advantages.

An important feature of the invention is the feature of a drawer partition which is readily stackable to afford layered partitioning in different-depth drawers.

Another feature of the invention is the provision of a drawer partition with removable dividers which are firmly and yet simply latched in place.

Still another feature of the invention is the provision of a drawer partition which can be nested end-to-end with other like partitions.

A still further feature of the invention is the provision of a drawer partition of the type set forth, which is of simple and economical construction.

These and other features of the invention are attained by providing a divided drawer partition comprising: a tray including a rectangular base wall and opposed upstanding side walls each terminating at an upper edge, each of the side walls having at least one groove therein substantially dovetail-shaped in transverse cross section and extending downwardly from the upper edge of the side wall, the base wall having at least one aperture therethrough, and an elongated divider having tongues respectively disposed at opposite ends thereof and a resilient latch structure projecting therefrom along a bottom edge thereof, the tongues being shaped for mateable sliding engagement respectively in the grooves and the latch structure being shaped and dimensioned to be resiliently snap-fitted in the aperture, the divider being shaped and dimensioned so as to be receivable in the tray in a use position extending between the side walls with the tongues respectively received in the grooves and with the latch structure snap-fitted in the aperture for dividing the tray into two compartments respectively disposed on opposite sides of said divider.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a fragmentary perspective view of a tool chest illustrating an open drawer containing a number of drawer partitions constructed in accordance with and embodying the features of the present invention;

FIG. 2 is a enlarged perspective view of one of the drawer partitions illustrated in FIG. 1;

DESCRIPTION OF THE PREFERRED EMBODIMENT

Figure 3:
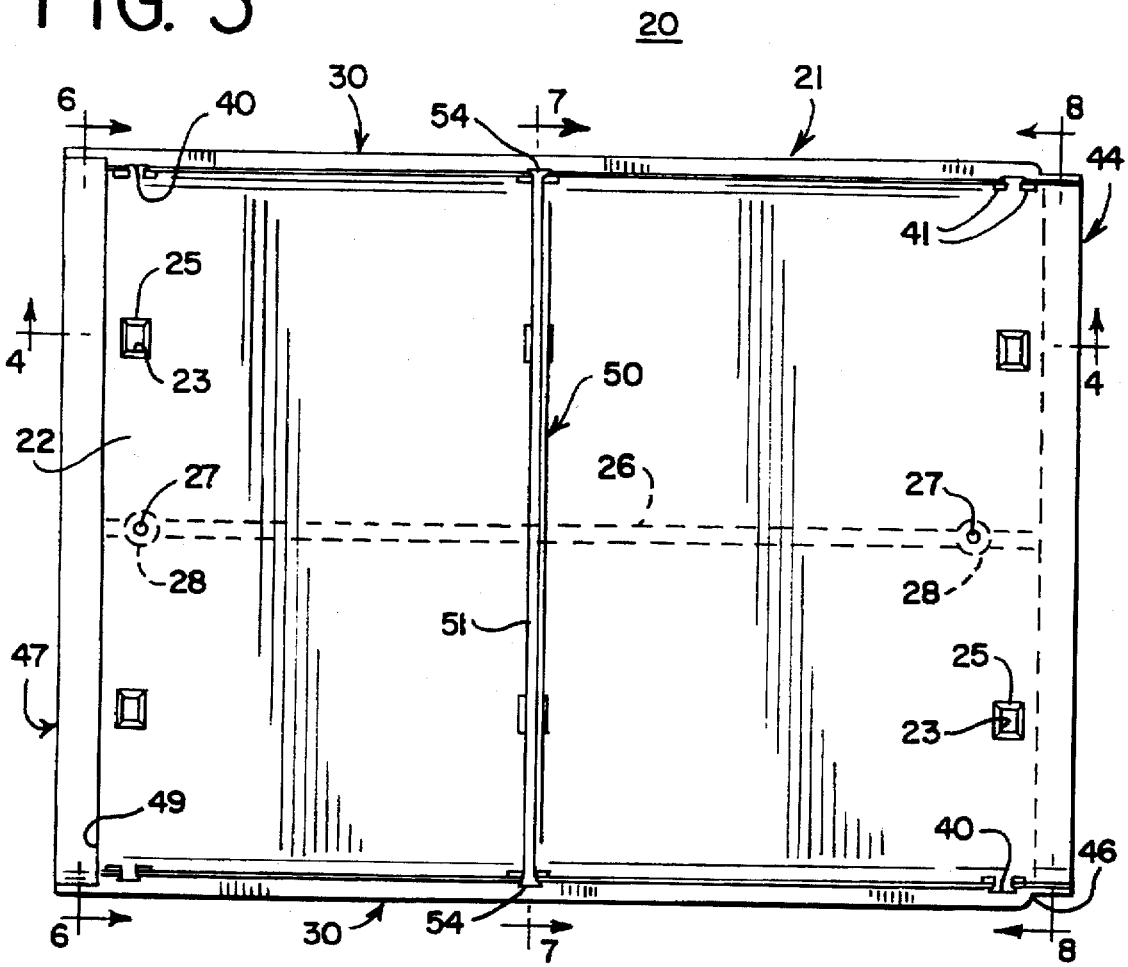
FIG. 3 is a further enlarged top plan view of the drawer partition of FIG. 2.

Referring to FIG. 1, there is illustrated a tool chest, generally designated by the numeral 10, which may be of the type used by mechanics in automotive service stations and the like. The tool chest 10 has a plurality of drawers 15, each of which has a rectangular bottom wall (not shown) and an upstanding front wall 16, opposed upstanding side walls 17, an upstanding rear wall (not shown) and a drawer pull 18 fixed to the front wall 16 and projecting forwardly therefrom, all in a known manner. Each of the drawers 15 is illustrated as being a laterally wide and vertically relatively shallow drawer, but it will be appreciated that the tool chest 10 could be provided with drawers of varying shapes and sizes.

One of the drawers 15 in FIG. 1 is illustrated with a plurality of drawer partitions 20, each constructed in accordance with and embodying the features of the present invention, for partitioning the drawer 15 into a plurality of compartments arranged side by side. As illustrated in FIG. 1, the open drawer 15 contains a plurality of substantially identically-sized and shaped drawer partitions 20. However, as will be explained in greater detail below, it will be appreciated that drawer partitions in accordance with the present invention could be provided in a number of different sizes and configurations.

Referring also to FIGS. 2–8, each drawer partition 20 includes a generally channel-shaped tray 21, which is of unitary, one-piece construction, preferably being molded of a suitable plastic material. The tray 21 has a rectangular base wall 22 provided with a plurality of longitudinally spaced-apart rows of apertures 23 therethrough, each row including at least two apertures 23 aligned laterally of the base wall 22. Preferably, each aperture 23 is generally rectangular in shape. Formed in the bottom surface of the base wall 22, respectively in surrounding relationship with the apertures 23, are shallow recesses 24 (see FIG. 7). Each aperture 23 is chamfered, as at 25, at the upper end thereof (see FIG. 3). The underside of the base wall 22 is provided with an elongated, longitudinally extending center rib 26. Respectively adjacent to the opposite ends of the rib 26 are screw holes 27 formed through the base wall 22 and surrounded with circular bosses 28. Elongated side ribs 29 are also formed on the underside of the base wall 22, respectively adjacent the side edges thereof and substantially parallel to the center rib 26.

The base wall 22 is integral at its side edges, respectively, with upstanding side walls 30 which are formed as mirror images of each other. Each of the side walls 30 has an elongated upper edge 31 and a lower edge 32. Formed in the lower edge 32 and extending substantially the entire length of the side wall 30 is an elongated groove 33 (see FIG. 6), which defines a generally rectangular bearing surface 34 (FIG. 7) and a downwardly extending and laterally outwardly facing retaining surface 35. A channel 36 separates the surfaces 34 and 35. Each side wall 30 has an upstanding flat inner surface 27, and has formed therein a plurality of longitudinally spaced-apart grooves 40, each of the grooves 40 being dovetail-shaped in transverse cross section and extending from the upper edge 31 downwardly a predetermined distance toward the base wall 22. Each of the grooves 40 is flanked by a pair of elongated guide ribs 41 which extend from the upper edge 31 substantially to the base wall 22 and cooperate to define therebetween an elongated slot 42. The grooves 40 and slots 42 are equal in number to and, respectively, laterally aligned with the rows of the apertures 23 in the base wall 22.

The tray 21 is provided at one end thereof with a front end portion 44 which constitutes an extension of the base wall 22 and the side walls 30, and has inclined upper edges 45 which slope downwardly from the upper edges 31 of the side walls 30. The inner surface of the end portion 44 is continuous with the inner surface of the base wall 22 and the side walls 30, but the outer surface thereof is recessed, as at 46, so that the end portion 44 is thinner than the main portion of the tray The tray 21 is provided at its other end with a rear end portion 47 which also constitutes an extension of the base wall 22 and the side walls 30 and is provided with upper edges 48 which are, respectively, stepped down a predetermined distance from the upper edges 31 of the side walls 30. The outer surface of the end portion 47 is substantially continuous with the outer surfaces of the base wall 22 and the side walls 30, but the inner surface of the end portion 47 is recessed, as at 49, so that the end portion 47 is thinner than the main portion of the tray 21.

The drawer partition 20 may be provided with one or more divider panels 50, one of which is shown in the drawer partition 20 illustrated in the drawings. The divider panel 50 is preferably also molded of a suitable plastic material and is a generally rectangular panel having an elongated upper edge 51 and a lower edge 52 and upstanding end edges 53 (see FIG. 7). The divider panel 50 is dimensioned to span the side walls 30 of the tray 21. More specifically, the end edges 53 of the divider panel 50 are dimensioned to be respectively slidably received in laterally aligned ones of the slots 42 in the side walls 30. In this regard, it will be appreciated that the slots 42 may be slightly tapered so as to guide sliding of the divider panel end edges 53 thereinto and to provide a slight wedging action. Respectively projecting laterally outwardly from the end edges 53 at the upper portions thereof are tongues 54, each being substantially dovetail-shaped in transverse cross section and respectively being dimensioned for being slidably mateably received in the grooves 40.

Depending from the lower edge 52 of the divider panel 50 are spaced-apart latching structures (see FIG. 7) equal in number to the base wall apertures 23 in a row thereof. Each of the latching structures 55 includes a pair of flexible dependent legs 56, each being provided at its distal end with a laterally outwardly extending foot 57. The latching structures 55 are so dimensioned that when the legs 56 are in their normal relaxed condition, the feet 57 will not pass through the associated aperture 23. However, the legs 56 may be resiliently flexed together sufficiently to permit the feet 57 to pass through the aperture 23, the legs 56 resiliently springing back to their normal position after passing through the aperture 23, with the feet 57 being received in the recess 24 on the underside of the base wall 22, securely to lock the divider panel 50 in place in the tray 21 for dividing the tray 21 into sub-compartments.

Figure 5:
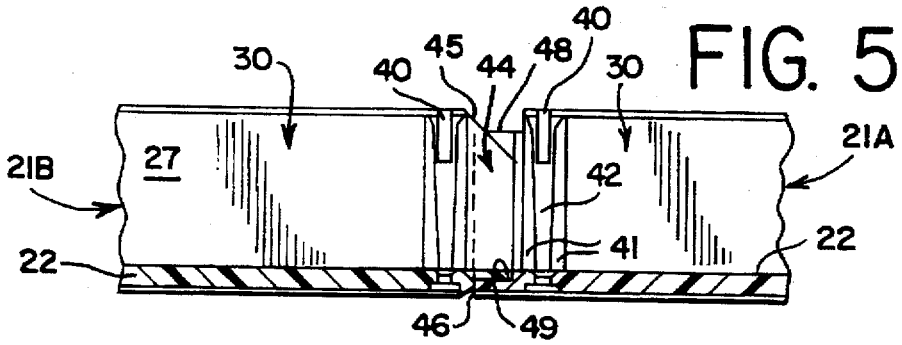
FIG. 5 is a fragmentary sectional view similar to FIG. 4 showing two of the drawer partitions of FIG. 4 in end-to-end nested relationship.
Figure 4:
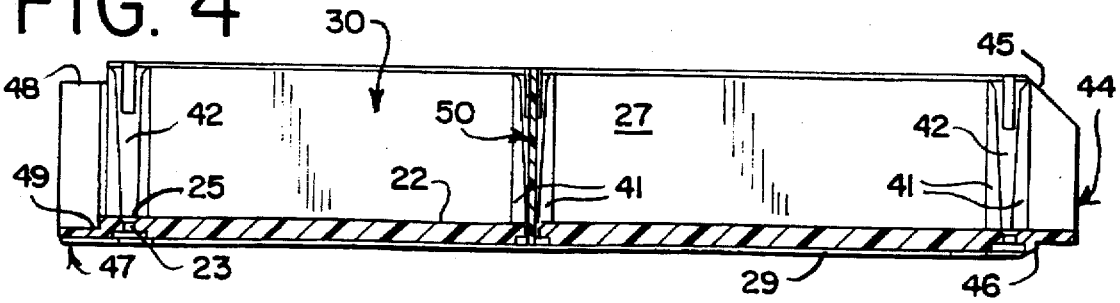
FIG. 4 is a view in vertical section taken along the line 4—4 in FIG. 3.
Figure 6:
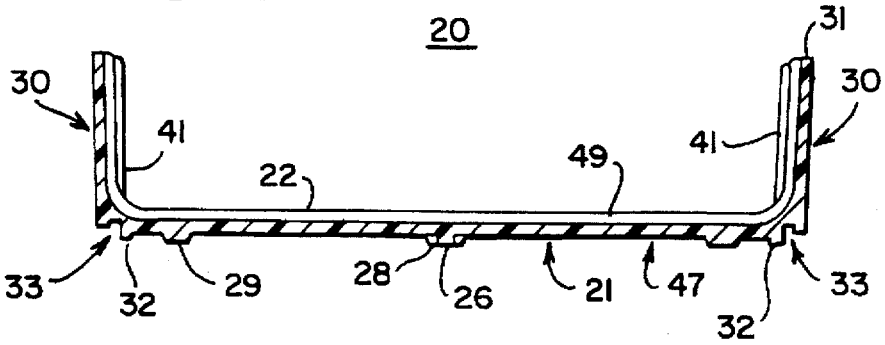
FIG. 6 is a view in vertical section taken along the line 6—6 in FIG. 3.
Figure 7:
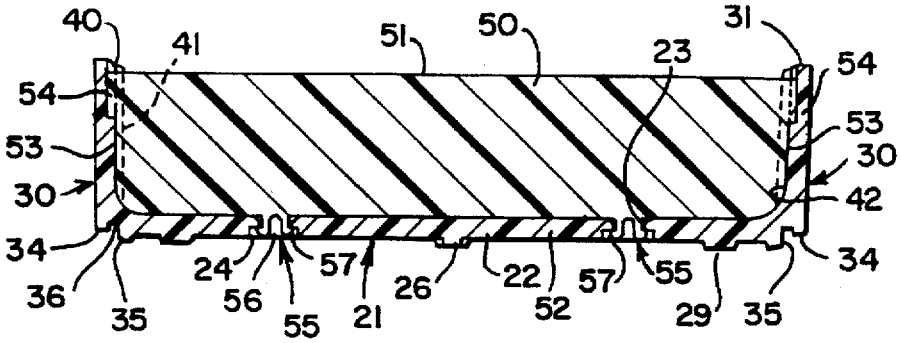
FIG. 7 is a view in vertical section taken along the line 7—7 in FIG. 3.
Figure 8:
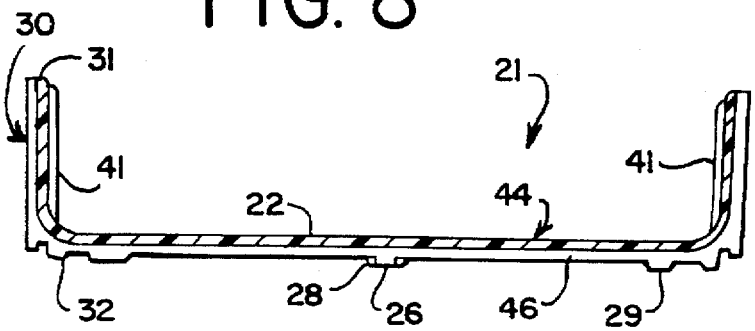
FIG. 8 is a view in vertical section taken along the line 8—8 in FIG. 3.

In use, the drawer partitions 20 are inserted in the drawer 15 in side-by-side abutting relationship so as to substantially fill the drawer 15. In the embodiment illustrated, the drawer partitions 20 have a length which is substantially equal to the front-to-back dimension of the drawer 15. However, it is a significant aspect of the invention that the drawer partition 20 may be used in drawers which have a front-to-back dimension substantially greater than the length of the drawer partition 20. In this regard, two of the drawer partitions 20 may be abutted in end-to-end relationship. Referring to FIG. 5, this arrangement is facilitated by the end portions 44 and 47. Thus, when two of the trays, designated 21A and 21B in FIG. 5, are arranged end to end, the front end portion 44 of the rear tray 21B nests inside the rear end portion 47 of the front tray 21A. When thus arranged, it can be seen that the inner surfaces of the base walls 22 are substantially coplanar and continuous with one another to provide a continuous partition. This nested overlapping relationship of the end portions 44 and 47 also serves to inhibit relative lateral shifting of the trays 21A and 21B with respect to each other and prevents stored material from falling between the two trays.

Figure 9:
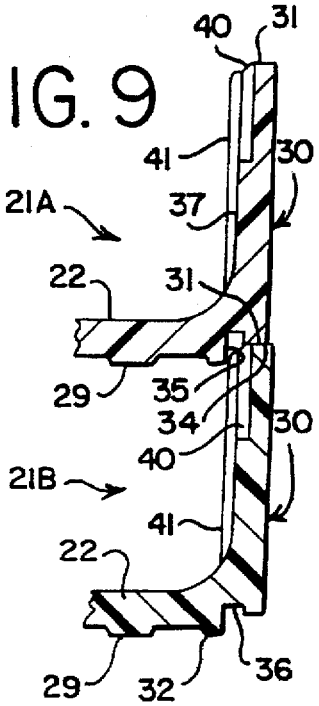
FIG. 9 is a further enlarged, fragmentary, sectional view of two of the drawer partitions of FIG. 2 in stacked relationship.

While the drawer partition 20 will typically have a vertical height or depth which is substantially the same as that of the associated drawer 15, it is another significant aspect of the invention that the drawer partitions 20 can be stacked to provide a layered compartmentalization of drawers which have a vertical height or depth substantially greater than that of the drawer partition 20. Referring to FIG. 9, when these two trays 21A and 21B are stacked one upon the other, the upper edges 31 of the side walls 30 of the lower tray 21B respectively fit within the grooves 33 in the lower edges 32 of the side walls 30 of the upper tray 21A. More specifically, the bearing surfaces 34 on the upper tray 21A respectively rest upon and bear against the upper edges 31 of the lower tray 21B, while the retaining surfaces 35 of the upper tray 21A respectively depend inside of the side walls 30 of the lower tray 21B, thereby to inhibit lateral shifting of the trays 21A and 21B relative to each other and permitting a guided longitudinal sliding movement of the trays 21A and 21B relative to each other. Thus, for example, in a typical arrangement, either the upper tray 21A may be shorter than the tray 21B or a single tray 21A may be stacked above end-to-end abutted lower trays 21B, so that the upper tray 21A can be slid forwardly and rearwardly of the drawer 15 to expose front and rear portions of the lower tray or trays 21B.

In the illustrated embodiment, the drawer partition 20 is shown with only a single divider panel 50. However, it will be appreciated that any number of divider panels 50 from zero up to the number of grooves 40 in a tray side wall 30 may be provided in each drawer partition 20, and a divider panel 50 may be selectively shifted from one position to another to provide different size sub-compartments. In this regard, it will be appreciated that, in order to remove a divider panel 50 from the tray 21, the legs 56 of the latching structures 55 are compressed together to permit them to be released from the apertures 23. It will also be appreciated that, when a divider panel 50 is mounted in place, as illustrated in the drawings, the cooperation of the end edges 53 thereof with the slots 42 and of the tongues 54 thereof in the grooves 40 firmly seats the divider panel 50 in place and prevents any longitudinal shifting of the position thereof or tilting thereof. While the drawer partition 20 has been shown with three pairs of grooves 40, it will be appreciated that any desired number can be provided, depending upon the length of the drawer partition 20. Also, while each of the rows of apertures 23 has been shown as including two such apertures, it will be appreciated that any number of apertures could be provided in each row, depending upon the width of the drawer partition 20. Also, it will be appreciated that, if desired, the drawer partition 20 could be provided without apertures 23 or grooves 40 in the event that division of the drawer partition 20 were deemed unnecessary.

While the drawer partitions 20 are illustrated as being simply freely seated in the drawer 15, it will be appreciated that they could be fixedly secured in place by suitable screws (not shown) passed through the screws holes 27 in the base wall 22.

From the foregoing, it can be seen that there has been provided an improved drawer partition which is of simple and economical construction and is shaped and dimensioned so as to facilitate end-to-end nesting and stacking, while at the same time providing movable divider panels which can be easily and effectively secured in place.

We claim:

1. A divided drawer partition comprising: a tray including a rectangular base wall and opposed upstanding side walls each terminating at an upper edge, each of said side walls having at least one groove therein substantially dovetail-shaped in transverse cross section and extending downwardly from the upper edge of said side wall, said base wall having at least one aperture therethrough, and an elongated divider having tongues respectively disposed at opposite ends thereof and a resilient latch structure projecting therefrom along a bottom edge thereof, said tongues being shaped for mateable sliding engagement respectively in said grooves and said latch structure being shaped and dimensioned to be resiliently snap-fitted in said aperture, said divider being shaped and dimensioned so as to be receivable in said tray in a use position extending between said side walls with said tongues respectively received in said grooves and with said latch structure snap-fitted in said aperture for dividing said tray into two compartments respectively disposed on opposite sides of said divider.

2. The drawer partition of claim 1, wherein said tray is of unitary one-piece construction.

3. The drawer partition of claim 1, wherein said tray is formed of plastic material.

4. The drawer partition of claim 1, wherein said grooves in said side walls and said aperture are all aligned laterally of said tray.

5. The drawer partition of claim 1, wherein said base wall has a plurality of apertures therethrough aligned laterally of said tray.

6. The drawer partition of claim 1, wherein each of said side walls has a plurality of dovetail-shaped grooves therein spaced apart longitudinally of said tray.

7. The drawer partition of claim 1, wherein said latch structure includes a pair of flexible, resilient, spaced-apart legs each having a laterally outwardly extending foot at its distal end, said legs and said feet being so dimensioned that in the normal relaxed condition thereof said feet will not fit through said aperture, said legs being resiliently deflectable together to permit said feet to pass through said aperture.

8. The drawer partition of claim 7, wherein said base wall has a recess formed in the outer surface thereof aligned with said aperture, said recess being dimensioned for receiving said feet therein when said legs are snap fitted in said aperture so that said feet are substantially flush with the outer surface of said base wall.

9. A stackable drawer partition comprising: a tray including a rectangular base wall and opposed upstanding side walls with each of said side walls terminating at an upper edge and a lower edge, each of said side walls having at least one first groove therein substantially dovetail-shaped in transverse cross section and extending downwardly from the upper edge of said side wall, said base wall having at least one aperture therethrough, and an elongated divider having tongues respectively disposed at opposite ends thereof and a resilient latch structure projecting therefrom along a bottom edge thereof, said tongues being shaped for mateable sliding engagement respectively in said first groove and said latch structure being shaped and dimensioned to be resiliently snap-fitted in said aperture, said divider being shaped and dimensioned so as to be receivable in said tray in a use position extending between said side walls with said tongues respectively received in said grooves and with said latch structure snap-fitted in said aperture for dividing said tray into two compartments respectively disposed on opposite sides of said divider, each of said side walls having a second groove formed in the lower edge thereof and extending the length thereof and defining a bearing surface generally parallel to said base wall and a retaining surface generally perpendicular to said bearing surface and depending therebelow, said second groove being shaped and dimensioned so that in use two of said trays may be stacked with said bearing surfaces of the upper tray being in sliding supported engagement respectively with the upper edges of the lower tray side walls, and with said retaining surfaces on the upper tray respectively depending alongside said side walls of the lower tray, thereby to accommodate guided sliding of the trays longitudinally relative to each other.

10. The drawer partition of claim 9, wherein each of said side walls has a plurality of dovetail-shaped grooves therein spaced apart longitudinally of said tray with the grooves on one of said side walls being respectively aligned with the grooves on the other of said side walls laterally of said tray, said base wall having a plurality of laterally extending rows of apertures therethrough with each of said rows being laterally aligned with a corresponding aligned pair of said grooves.

11. The drawer partition of claim 9, wherein said latch structure includes a pair of flexible, resilient, spaced-apart legs each having a laterally outwardly extending foot at its distal end, said legs and said feet being so dimensioned that in the normal relaxed condition thereof said feet will not fit through said aperture, said legs being resiliently deflectable together to permit said feet to pass through said aperture.

12. The drawer partition of claim 9, and further comprising a first end portion at one end of said tray extending from said base wall and said side walls having a recessed outer surface, and a second end portion at the other end of said tray extending from said base wall and said side walls having a recessed inner surface, said first and second end portions being shaped and dimensioned so that in use two of said trays may be nested end-to-end with said first end portion of one tray being nested within said second end portion of the other tray.

* * * * *